US011576538B2

(12) United States Patent
Adachi et al.

(10) Patent No.: US 11,576,538 B2
(45) Date of Patent: Feb. 14, 2023

(54) ELECTRIC BLOWER, ELECTRIC VACUUM CLEANER, AND HAND DRIER

(71) Applicants: Mitsubishi Electric Corporation, Tokyo (JP); Mitsubishi Electric Home Appliance Co., Ltd., Saitama (JP)

(72) Inventors: Naho Adachi, Tokyo (JP); Takashi Ikeda, Tokyo (JP); Kazuchika Tsuchida, Tokyo (JP); Mamoru Hayatsu, Fukaya (JP); Mitsumasa Hamazaki, Fukaya (JP); Masaya Teramoto, Fukaya (JP)

(73) Assignees: Mitsubishi Electric Corporation, Tokyo (JP); Mitsubishi Electric Home Appliance Co., Ltd., Fukaya (JP)

( * ) Notice: Subject to any disclaimer, the term of this patent is extended or adjusted under 35 U.S.C. 154(b) by 615 days.

(21) Appl. No.: 16/486,368

(22) PCT Filed: May 1, 2017

(86) PCT No.: PCT/JP2017/017142
§ 371 (c)(1),
(2) Date: Aug. 15, 2019

(87) PCT Pub. No.: WO2018/203366
PCT Pub. Date: Nov. 8, 2018

(65) Prior Publication Data

US 2020/0237166 A1 Jul. 30, 2020

(51) Int. Cl.
*F04D 25/06* (2006.01)
*A47K 10/48* (2006.01)
(Continued)

(52) U.S. Cl.
CPC ..... *A47K 10/48* (2013.01); *A47K 10/00* (2013.01); *A47L 5/22* (2013.01); *A47L 7/0019* (2013.01);
(Continued)

(58) Field of Classification Search
None
See application file for complete search history.

(56) References Cited

U.S. PATENT DOCUMENTS

2008/0014080 A1* 1/2008 Fang ..... A47L 5/22 415/191
2011/0070108 A1* 3/2011 Arita ..... H02K 21/046 310/46
(Continued)

FOREIGN PATENT DOCUMENTS

JP H11-294390 A 10/1999
JP 2016-138511 A 8/2016

OTHER PUBLICATIONS

International Search Report of the International Searching Authority dated Jul. 11, 2017 for the corresponding international application No. PCT/JP2017/017142 (and English translation).

*Primary Examiner* — Michael Lebentritt
(74) *Attorney, Agent, or Firm* — Posz Law Group, PLC

(57) ABSTRACT

An electric blower includes a motor unit, a shaft, a centrifugal impeller, a fan cover, a motor unit case, and a bracket located away from centrifugal impeller and toward motor unit in a direction in which a central axis of the shaft extends. The bracket includes a first portion located outward of the vent in a radial direction, and a second portion located outward of the first portion and outward of an outer circumference of the motor unit case in the radial direction. A first airflow passage and a second airflow passage are formed in the bracket, the first and second airflow passages commu-
(Continued)

nicate with an airflow passage formed by the centrifugal impeller and the fan cover.

14 Claims, 10 Drawing Sheets

(51) Int. Cl.

| | |
|---|---|
| ***A47L 9/22*** | (2006.01) |
| ***F04D 29/043*** | (2006.01) |
| ***F04D 29/28*** | (2006.01) |
| ***F04D 29/42*** | (2006.01) |
| ***A47K 10/00*** | (2006.01) |
| ***A47L 5/22*** | (2006.01) |
| ***A47L 9/06*** | (2006.01) |
| ***A47L 7/00*** | (2006.01) |
| ***F04D 29/44*** | (2006.01) |
| ***F04D 25/08*** | (2006.01) |
| ***F04D 17/16*** | (2006.01) |
| *A47L 5/24* | (2006.01) |

(52) U.S. Cl.
CPC ..... *A47L 9/0693* (2013.01); *A47L 9/22* (2013.01); *F04D 17/168* (2013.01); *F04D 25/06* (2013.01); *F04D 25/082* (2013.01); *F04D 29/043* (2013.01); *F04D 29/281* (2013.01); *F04D 29/4226* (2013.01); *F04D 29/444* (2013.01); *A47L 5/24* (2013.01)

(56) References Cited

U.S. PATENT DOCUMENTS

2012/0237373 A1* 9/2012 Li ..... H02K 9/06 417/410.1
2013/0251560 A1* 9/2013 Xue ..... F04D 29/444 417/410.1
2014/0369869 A1* 12/2014 Oh ..... F04D 29/102 417/423.13
2015/0308447 A1* 10/2015 Ye ..... F04D 29/281 34/523
2017/0054352 A1* 2/2017 Li ..... H02K 3/18
2019/0101129 A1* 4/2019 Teramoto ..... F04D 29/624
2019/0242397 A1* 8/2019 Adachi ..... F04D 29/441

* cited by examiner

ELECTRIC BLOWER, ELECTRIC VACUUM CLEANER, AND HAND DRIER

CROSS REFERENCE TO RELATED APPLICATION

This application is a U.S. national stage application of PCT/JP2017/017142 filed on May 1, 2017, the contents of which are incorporated herein by reference.

TECHNICAL FIELD

The present invention relates to an electric blower, an electric vacuum cleaner, and a hand drier.

BACKGROUND ART

Japanese Patent Laying-Open No. 2016-138511 discloses an electric blower including a frame that holds a bearing forming the electric blower, and a fan casing fastened to the frame, as well as an electric vacuum cleaner including the electric blower.

CITATION LIST

Patent Literature

PTL 1: Japanese Patent Laying-Open No. 2016-138511

SUMMARY OF INVENTION

Technical Problem

Recently, there has been a strong demand for an electric blower of smaller size and higher efficiency, and the parts used for the electric blower are each required to be reduced in size and enhanced in efficiency.

In order to reduce the size and enhance the efficiency of the electric blower, it is necessary to improve the blowing efficiency of the electric blower and the cooling efficiency for a motor unit.

The present invention has been made to solve the above-described problem, and an object is to provide an electric blower improved in blowing efficiency of the electric blower and cooling efficiency for a motor unit, as well as an electric vacuum cleaner and a hand drier each including the electric blower.

Solution to Problem

An electric blower according to the present invention includes a motor unit, a shaft to be driven by the motor unit, a centrifugal impeller fastened to the shaft, a fan cover that houses the centrifugal impeller, a motor unit case that houses the motor unit and has a vent located in the motor unit case, and a bracket located away from the centrifugal impeller and toward the motor unit in a direction in which a central axis of the shaft extends. The bracket includes a first portion located outward of the vent in a radial direction which is a direction of a radius centered at the central axis, and a second portion located outward of the first portion and outward of an outer circumference of the motor unit case in the radial direction. The second portion is located outward of the first portion as seen in the direction in which the shaft extends. A first airflow passage and a second airflow passage are formed in the bracket. The first airflow passage and the second airflow passage communicate with an airflow passage formed by the centrifugal impeller and the fan cover. The first airflow passage is defined by at least an inner circumferential surface of the first portion. The second airflow passage is defined by at least an outer circumferential surface of the first portion and an inner circumferential surface of the second portion.

Advantageous Effects of Invention

In accordance with the present invention, an electric blower improved in blowing efficiency of the electric blower and cooling efficiency for a motor unit, as well as an electric vacuum cleaner and a hand drier each including the electric blower can be provided.

DESCRIPTION OF EMBODIMENTS

Figure 1:
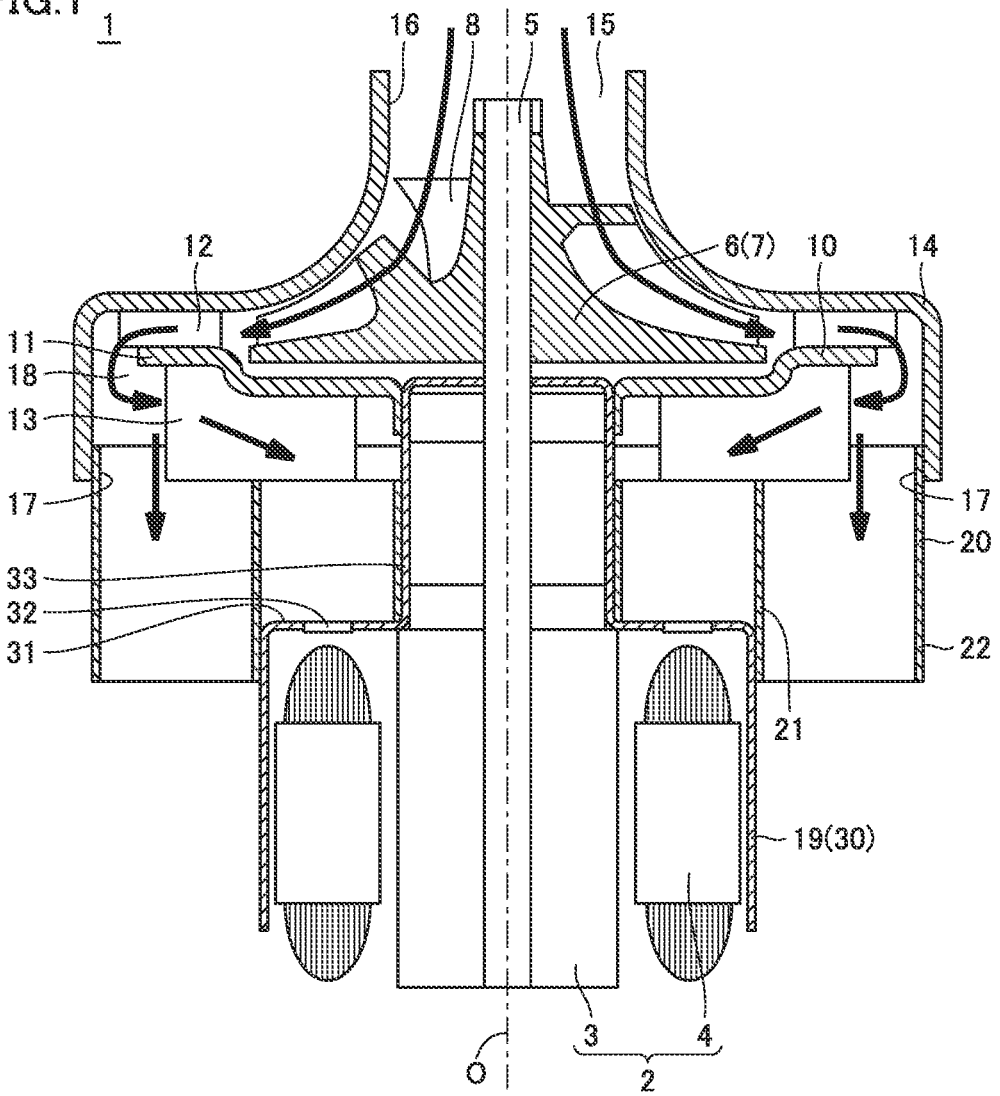
FIG. 1 is a schematic cross-sectional view of an electric blower according to Embodiment 1.

Embodiments of the present invention are described hereinafter with reference to the drawings. In the following drawings, the same or corresponding parts are denoted by the same reference numerals, and a description thereof is not repeated.

Embodiment 1

Figure 2:
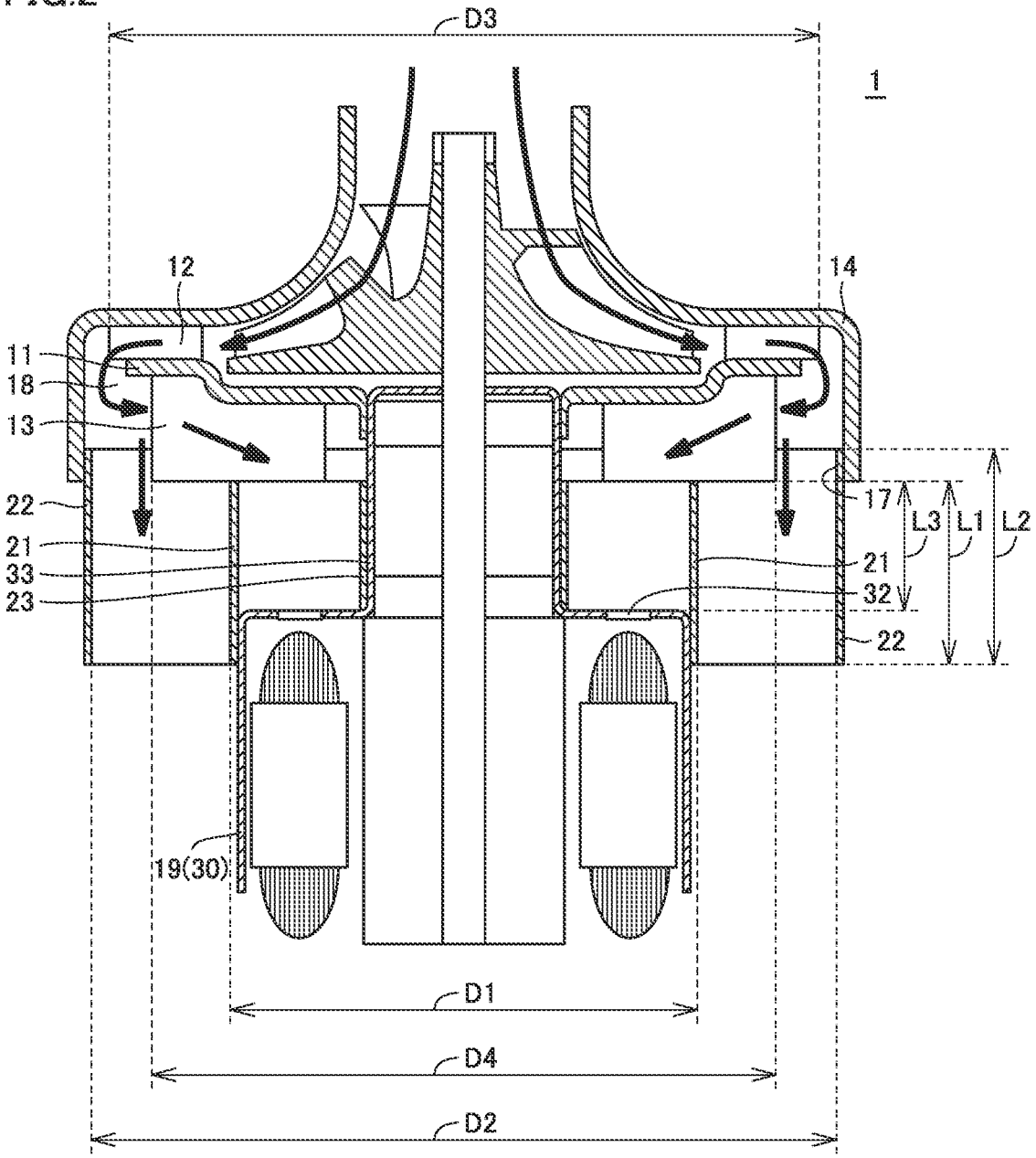
FIG. 2 is a schematic cross-sectional view of the electric blower according to Embodiment 1.
Figure 3:
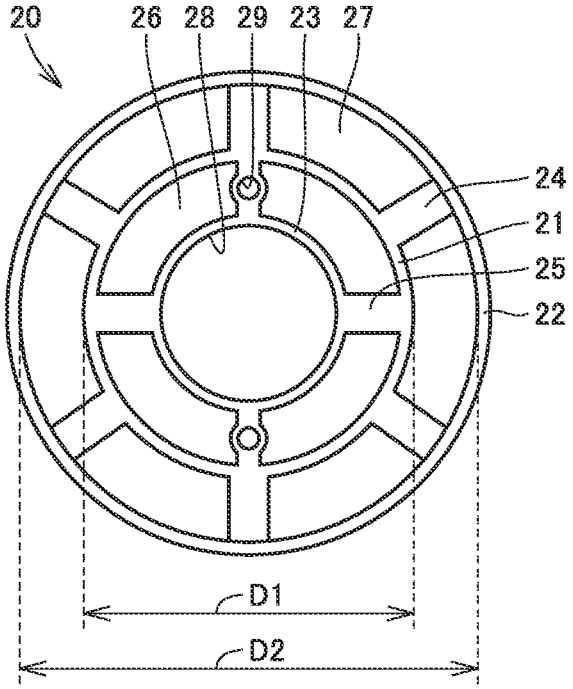
FIG. 3 is a plan view showing a bracket of the electric blower according to Embodiment 1.

As shown in FIGS. 1 to 3, an electric blower 1 according to Embodiment 1 mainly includes a motor unit 2, a shaft 5, a centrifugal impeller 6, a diffuser 10, a fan cover 14, a motor unit case 19, and a bracket 20.

Motor unit 2 includes a rotor 3 and a stator 4. Rotor 3 is fastened to shaft 5 serving as an output shaft. Shaft 5 includes a portion fastened to rotor 3, a portion rotatably supported by a bearing (not shown), and a portion fastened to centrifugal impeller 6. Motor unit 2 rotates centrifugal impeller 6 through shaft 5 (rotational shaft). Centrifugal impeller 6 is driven to form an airflow passage in electric blower 1. The arrows in FIGS. 1 and 2 indicate the airflow passage. The direction in which a central axis O of shaft 5

(see FIG. 1) extends is hereinafter referred to simply as extending direction. The radial direction perpendicular to the extending direction and directed radially outward from the center of shaft 5 is hereinafter referred to simply as radial direction. In the extending direction, the intake side of electric blower 1 is hereinafter referred to as front side, and the side opposite to the intake side is hereinafter referred to as back side. In the radial direction, the shaft 5 side is hereinafter referred to as radially inner side or radially inward, and the side opposite to the radially inner side is hereinafter referred to as radially outer side or radially outward.

Centrifugal impeller 6 includes a hub 7 and a plurality of rotor blades 8. Hub 7 is fastened to shaft 5. As seen in the extending direction, the outline of hub 7 in plan view is circular. A central portion of hub 7 in the radial direction protrudes toward the front side relative to an outer peripheral portion of hub 7 located outward of the central portion in the radial direction. In other words, hub 7 has a surface extending in a direction crossing the extending direction. A plurality of rotor blades 8 are located on the aforementioned surface of hub 7 and spaced from each other in a rotational direction perpendicular to the extending direction.

Diffuser 10 is disposed between motor unit 2 and centrifugal impeller 6 in the extending direction. Between diffuser 10 and fan cover 14 described later herein, a part of the airflow passage formed in electric blower 1 by centrifugal impeller 6 is located. Diffuser 10 is located downstream of centrifugal impeller 6 and upstream of bracket 20 described later herein, with respect to the airflow passage formed in electric blower 1 by centrifugal impeller 6. Diffuser 10 includes a main plate 11, a plurality of stator vanes 12, and a plurality of return stator vanes 13.

Main plate 11 has a front surface extending in the aforementioned crossing direction and located on the centrifugal impeller 6 side (front side) in the extending direction, and a back surface extending in the crossing direction and located on the motor unit 2 side (back side) in the extending direction.

A plurality of stator vanes 12 are coupled to the front surface of main plate 11. Each of a plurality of stator vanes 12 is formed outward of a plurality of rotor blades 8 of centrifugal impeller 6 in the radial direction. A plurality of stator vanes 12 are arranged annularly and spaced from each other in the rotational direction. A plurality of return stator vanes 13 are coupled to the back surface of main plate 11. A plurality of return stator vanes 13 are arranged annularly and spaced from each other in the rotational direction.

Fan cover 14 houses centrifugal impeller 6 and a plurality of stator vanes 12 of diffuser 10. Fan cover 14 is located outward of a plurality of rotor blades 8 and a plurality of stator vanes 12 in the extending direction. A central portion on the front side of fan cover 14 is a bell mouth 16 defining an outer rim of an inlet 15 of centrifugal impeller 6. The back side of fan cover 14 has an opening 17 defining an outer rim of an outlet of diffuser 10.

Between fan cover 14 and main plate 11, a deflector 18 is formed to connect a gas flow channel between stator vanes 12 to a gas flow channel between return stator vanes 13. At deflector 18, the gas flow direction is turned.

Motor unit case 19 houses motor unit 2, a portion of shaft 5 fastened to rotor 3, and a portion of shaft 5 rotatably supported by the bearing.

Motor unit case 19 includes a portion 30 that faces stator 4 of motor unit 2 in the radial direction. This portion 30 of motor unit case 19 extends in the extending direction. Motor unit case 19 further includes a portion 31 that faces return stator vanes 13 of diffuser 10 in the extending direction. This portion 31 of motor unit case 19 has at least one vent 32 disposed to face stator 4 of motor unit 2 in the extending direction, and vent 32 connects the inside and the outside of motor unit case 19 to each other. Vent 32 faces return stator vane 13 in the extending direction, for example. A plurality of (four for example) vents 32 are spaced from each other in the circumferential direction, for example. This portion 31 of motor unit case 19 has at least one fastening hole 34 (see FIG. 4) in addition to vent(s) 32.

Further, motor unit case 19 includes a portion 33 located inside return stator vanes 13 of diffuser 10 and located inside the aforementioned portion of motor unit case 19 that faces return stator vanes 13 of diffuser 10 in the extending direction. This portion 33 of motor unit case 19 houses the bearing which rotatably supports shaft 5. This portion 33 of motor unit case 19 is located on the front side and the radially inner side relative to portion 30 of motor unit case 19. Portion 33 of motor unit case 19 is connected to portion 30 through portion 31. The material forming motor unit case 19 may be any material, and preferably includes a material having a relatively high thermal conductivity, and preferably includes metal, for example.

Bracket 20 is located away from centrifugal impeller 6 and toward motor unit 2 in the direction in which central axis O of shaft 5 extends. Bracket 20 includes a first portion 21 located outward of vent 32 in the direction of the radius centered at central axis O, and a second portion 22 located outward of first portion 21 in the radial direction and located outward of the outer periphery (aforementioned portion 30) of motor unit case 19 in the radial direction. First portion 21 is coupled to motor unit case 19, for example. Second portion 22 is coupled to fan cover 14, for example. The material forming bracket 20 may be any material, and preferably includes a metal material such as die-cast aluminum, die-cast magnesium, or resin, for example.

Preferably, the material forming bracket 20 includes resin, and more preferably includes thermally-resistant engineering plastic, and includes syndiotactic polystyrene (SPS) or polyphenylene sulfide (PPS), for example.

First portion 21 is located radially outward of aforementioned portions 30 to 33 of motor unit case 19. First portion 21 includes a portion located to overlap portion 33 of motor unit case 19 in the radial direction, and a portion located to overlap portion 30 of motor unit case 19 in the radial direction. First portion 21 is located radially outward of vent 32 of motor unit case 19. As shown in FIG. 3, as seen in the extending direction, first portion 21 is annular in plan view, for example. As seen in the extending direction, the center of first portion 21 overlaps the center of second portion 22, for example.

First portion 21 has a back end as one end and a front end as the other end in the extending direction, the back end is coupled to motor unit case 19, and the front end is not coupled to motor unit case 19. The front end of first portion 21 is connected to return stator vanes 13, for example. The front end of first portion 21 is located on the back side relative to the front end of second portion 22. The back end of first portion 21 is coupled to a portion of motor unit case 19 that is located on the front side of portion 30. The back end of first portion 21 is located to overlap portion 30 of motor unit case 19 in the radial direction. Preferably, portion 30 of motor unit case 19 includes a front portion 30A (see FIG. 2) located to overlap first portion 21 in the radial direction, and a back portion 30B (see FIG. 2) located not to overlap first portion 21 in the radial direction. More preferably, front portion 30A of portion 30 of motor unit case 19 that is located to overlap first portion 21 in the radial direction is narrower than back portion 30B of portion 30 located not to overlap first portion 21 in the radial direction.

First portion 21 is located radially inward of the radially outer end of at least one return stator vane 13. First portion 21 is located radially outward of the radially inner end (the end of return stator vane 13 that is located downstream of the aforementioned airflow passage) of at least one return stator vane 13.

Second portion 22 is located radially outward of first portion 21. Second portion 22 includes a portion that faces first portion 21 in the radial direction. In other words, bracket 20 has at least a double structure. Second portion 22 includes a portion located to overlap return stator vane 13 in the radial direction, a portion located to overlap portion 33 of motor unit case 19 in the radial direction, and a portion located to overlap portion 30 of motor unit case 19 in the radial direction.

Second portion 22 has a front end as one end and a back end as the other end in the extending direction, the front end is coupled to fan cover 14, and the back end is not coupled to fan cover 14. The front end of second portion 22 is coupled to opening 17 of fan cover 14, for example. The front end of second portion 22 is located to overlap return stator vane 13 in the radial direction, for example. The back end of second portion 22 is located to overlap portion 30 of motor unit case 19 in the radial direction, for example. Second portion 22 is located to overlap only a part of portion 30 of motor unit case 19 in the radial direction, for example.

Second portion 22 is located radially outward of the radially outer end (the end of return stator vane 13 located upstream of the aforementioned airflow passage) of return stator vane 13. Second portion 22 is located radially outward of the radially outer end (the end of stator vane 12 located downstream of the aforementioned airflow passage) of stator vane 12. As shown in FIG. 3, as seen in the extending direction, second portion 22 is annular in plan view, for example.

As shown in FIG. 2, outer diameter D1 of first portion 21, inner diameter D2 of second portion 22, and diameter D3 of the circle circumscribing the radially outer ends of stator vanes 12 satisfy a relation: D2>D3>D1. Outer diameter D1 of first portion 21, inner diameter D2 of second portion 22, and diameter D4 of the circle circumscribing the radially outer ends of return stator vanes 13 satisfy a relation: D2>D4>D1. Preferably, diameter D3 of the circle circumscribing a plurality of stator vanes 12 is more than or equal to diameter D4 of the circle circumscribing a plurality of return stator vanes 13. Preferably, D1, D2, D3, and D4 have a relation: D2>D3>D4>D1. Preferably, diameter D3 of the circle circumscribing a plurality of stator vanes 12 is more than or equal to the diameter of the circle inscribing the radially outer rim of main plate 11.

As shown in FIG. 2, width L2 of second portion 22 in the extending direction is more than or equal to width L1 of first portion 21. For example, width L2 is longer than width L1.

As shown in FIG. 3, bracket 20 further includes a third portion 23 located radially inward of first portion 21, a plurality of coupling portions 24 coupling first portion 21 to second portion 22, and a plurality of coupling portions 25 coupling first portion 21 to third portion 23.

Third portion 23 is located radially outward of portion 33 of motor unit case 19 and located radially inward of portion 30 thereof. Third portion 23 is located to overlap portion 33 of motor unit case 19 in the radial direction. Third portion 23 is located radially inward of vent 32 of motor unit case 19. As shown in FIG. 3, as seen in the extending direction, third portion 23 is annular in plan view, for example. As seen in the extending direction, the center of third portion 23 overlaps the centers of first portion 21 and second portion 22, for example.

A plurality of coupling portions 24 are spaced from each other in the circumferential direction. A plurality of coupling portions 25 are spaced from each other in the circumferential direction. Each of a plurality of coupling portions 24 has a cross section perpendicular to the radial direction, and this cross section has a rectangular shape, for example. A plurality of coupling portions 24 each have the width in the extending direction larger than its width in the direction perpendicular to the radial direction and perpendicular to the extending direction. The number of coupling portions 24 is larger than that of coupling portions 25, for example.

In bracket 20, a plurality of first through holes 26 are located between first portion 21 and third portion 23. A plurality of first through holes 26 are spaced from each other in the circumferential direction. First through holes 26 adjacent to each other in the circumferential direction are arranged with coupling portion 25 interposed therebetween. The front end of each first through hole 26 is located on the back side relative to return stator vanes 13. Specifically, the front end of each first through hole 26 is connected to an airflow passage formed in electric blower 1 by centrifugal impeller 6. In other words, a first airflow passage made of first through hole 26 is formed in bracket 20. In the radial direction, the first airflow passage is defined by the inner circumferential surface of first portion 21. In the circumferential direction, the first airflow passage is defined by the side surfaces of coupling portions 25. The back end of first through hole 26 is located on the front side relative to portion 31 of motor unit case 19. Specifically, each first through hole 26 forms the first airflow passage directing the airflow passage formed in electric blower 1 by centrifugal impeller 6 into motor unit case 19 through vent 32 located in portion 31 of motor unit case 19.

Further, in bracket 20, a plurality of second through holes 27 are located between first portion 21 and second portion 22. A plurality of second through holes 27 are spaced from each other in the circumferential direction. Second through holes 27 adjacent to each other in the circumferential direction are arranged with coupling portion 24 interposed therebetween. The front end of each second through hole 27 is located on the back side relative to deflector 18 of diffuser 10. Specifically, the front end of each second through hole 27 is connected to the airflow passage formed in electric blower 1 by centrifugal impeller 6. In other words, a second airflow passage made of second through hole 27 is formed in bracket 20. In the radial direction, the second airflow passage is defined by the outer circumferential surface of first portion 21 of bracket 20 and the inner circumferential surface of second portion 22. In the circumferential direction, the second airflow passage is defined by the side surfaces of coupling portions 24. The back end of each second through hole 27 is located on the back side relative to portion 31. The back end of each second through hole 27 is located to overlap portion 30 of motor unit case 19 in the radial direction. Specifically, second through hole 27 forms the second airflow passage directing the airflow passage formed in electric blower 1 by centrifugal impeller 6 radially outward of portion 30 of motor unit case 19.

Further, in bracket 20, a third through hole 28 is located radially inward of third portion 23, and a fourth through hole(s) 29 is located in at least one or some of a plurality of coupling portions 25.

Preferably, as seen in the extending direction, the total area of a plurality of second through holes 27 is larger than the total area of a plurality of first through holes 26. In other words, as seen in the extending direction, the area of the second airflow passage is larger than the area of the first airflow passage. Preferably, the ratio of the total area of a plurality of second through holes 27 to the total area of a plurality of first through holes 26 is more than or equal to 1.2 and less than or equal to 4. As seen in the extending direction, the total area of a plurality of second through holes 27 is larger than the area of third through hole 28. As seen in the extending direction, the area of a single first through hole 26 is larger than the area of a single fourth through hole 29.

Figure 4:
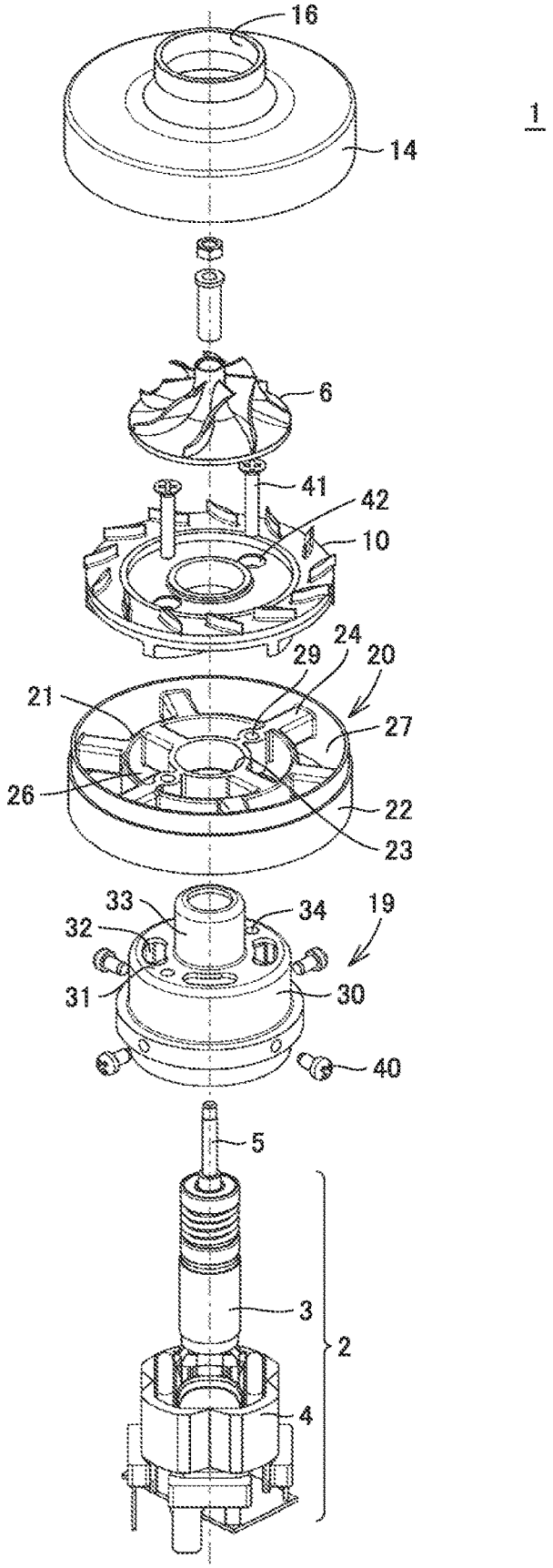
FIG. 4 is a perspective exploded view showing the electric blower according to Embodiment 1.

As shown in FIG. 4, fan cover 14, centrifugal impeller 6, diffuser 10, bracket 20, motor unit case 19, and motor unit 2 are laid on each other in electric blower 1. Stator 4 of motor unit 2 and motor unit case 19 are fastened to each other with a fastening member 40 such as screw. Diffuser 10, bracket 20, and motor unit case 19 are fastened to each other with a fastening member 41 such as screw. Fastening member 41 is inserted in a through hole 42 located radially inward of main plate 11 of diffuser 10 and in aforementioned fourth through hole 29 of bracket 20, and fastened in aforementioned fastening hole 34. Fan cover 14 is fastened to second portion 22 of bracket 20. Accordingly, fan cover 14, diffuser 10, bracket 20, motor unit case 19, and stator 4 of motor unit 2 are fastened to each other in the extending direction, the radial direction, and the circumferential direction.

<Operation of Electric Blower>

As shown in FIG. 1, shaft 5 of electric blower 1 is rotated as power is fed to motor unit 2. As shaft 5 is rotated, centrifugal impeller 6 attached to shaft 5 is rotated to suck air from inlet 15. The air sucked by centrifugal impeller 6 into electric blower 1 is increased in pressure and speed by centrifugal impeller 6 and directed radially outward while being turned. The air discharged from centrifugal impeller 6 is reduced in speed and increased in pressure between a plurality of stator vanes 12 of diffuser 10. After this, the air flowing between a plurality of stator vanes 12 is directed to deflector 18. A part of the air fed to deflector 18 is directed into the second airflow passage of bracket 20 and then directed radially outward of portion 30 of motor unit case 19. The remainder of the air fed to deflector 18 is directed by return stator vanes 13 into the first airflow passage of bracket 20 and fed through vent 32 into motor unit case 19. The air fed into motor unit case 19 is discharged outward from an exhaust port (not shown) of motor unit case 19.

<Advantageous Effects of Electric Blower>

As shown in FIGS. 1 to 4, electric blower 1 includes motor unit 2, shaft 5 to be driven by motor unit 2, centrifugal impeller 6 fastened to shaft 5, fan cover 14 that houses centrifugal impeller 6, motor unit case 19 that houses motor unit 2 and has vent 32 located in the motor unit case, and bracket 20 located away from centrifugal impeller 6 and toward motor unit 2 in the direction in which central axis O of shaft 5 extends. Bracket 20 includes first portion 21 located outward of vent 32 in the radial direction which is the direction of the radius centered at central axis O, and second portion 22 located outward of first portion 21 and outward of the outer circumference of motor unit case 19 in the radial direction. The first airflow passage and the second airflow passage are formed in bracket 20, and the first airflow passage and the second airflow passage communicate with the airflow passage formed by centrifugal impeller 6 and fan cover 14. The first airflow passage is defined by at least the inner circumferential surface of first portion 21, and the second airflow passage is defined by at least the outer circumferential surface of first portion 21 and the inner circumferential surface of second portion 22.

In such an electric blower 1, two airflow passages that are different from each other in pressure loss, i.e., first airflow passage and second airflow passage, are formed downstream of centrifugal impeller 6. The second airflow passage is lower in airflow impedance than the first airflow passage. In contrast, the first airflow passage located radially inward of the second airflow passage is capable of efficiently cooling motor unit 2. Electric blower 1 therefore has high cooling efficiency for motor unit 2 and high blowing efficiency as compared with conventional electric blowers.

Further, first portion 21 which defines the radially inner end of the second airflow passage is coupled to motor unit case 19. Therefore, the air directed into the second airflow passage can be fed to the outer circumferential surface of motor unit case 19. Thus, the second airflow passage of electric blower 1 can also contribute to cooling of motor unit 2. Electric blower 1 is therefore enhanced in both the blowing efficiency and the cooling efficiency, as compared with conventional electric blowers. Electric blower 1 therefore has a higher efficiency and a longer life as compared with conventional electric blowers.

In electric blower 1, the area of the second airflow passage is larger than the area of the first airflow passage as seen in the extending direction.

The airflow impedance of such a second airflow passage is lower than that of the second airflow passage of which area is less than or equal to the area of the first airflow passage. Electric blower 1 is therefore higher in blowing efficiency than conventional electric blowers. Preferably, the ratio of the total area of a plurality of second through holes 27 to the total area of a plurality of first through holes 26 is more than or equal to 1.2 and less than or equal to 4. If this ratio is less than 1.2, the airflow impedance of the second airflow passage cannot be reduced sufficiently. If the ratio is more than 4, the airflow volume supplied through vent 32 into motor unit case 19 is reduced and stator 4 cannot be cooled sufficiently. The ratio satisfying the aforementioned range enables both the blowing efficiency and the cooling efficiency to be achieved at a high level.

Electric blower 1 further includes diffuser 10 located downstream of centrifugal impeller 6 and located upstream of bracket 20, with respect to the airflow passage formed by centrifugal impeller 6. Diffuser 10 includes a plurality of stator vanes 12 and a plurality of return stator vanes 13. The radially outer end of at least one of a plurality of return stator vanes 13 is located radially outward of first portion 21.

Thus, the airflow impedance of the second airflow passage is lower than that in the blower in which the radially outer end of each return stator vane 13 is located radially inward of first portion 21. Accordingly, electric blower 1 is still higher in blowing efficiency than conventional electric blowers.

In electric blower 1, the radially inner end of at least one of a plurality of return stator vanes 13 is located radially inward of first portion 21.

Thus, the air discharged from diffuser 10 can be directed more efficiently into the first airflow passage by return stator vanes 13, as compared with a blower in which the radially inner end of each return stator vane 13 is located radially outward of first portion 21. Motor unit 2 can therefore be cooled more efficiently by the first airflow passage.

In electric blower 1, diffuser 10 further includes main plate 11 coupling a plurality of stator vanes 12 to a plurality of return stator vanes 13. Outer diameter D3 of the circle circumscribing a plurality of stator vanes 12 is larger than the outer diameter of main plate 11.

In such electric blower 1, while deflector 18 is formed between main plate 11 and fan cover 14 for deflecting the airflow direction, the radially outer ends of a plurality of stator vanes 12 located away from main plate 11 are formed closer to fan cover 14. In electric blower 1, therefore, the rate of increase of the static pressure is increased and the airflow impedance of deflector 18 is reduced to thereby provide high efficiency.

Regarding electric blower 1, preferably the material forming motor unit case 19 includes metal. Thus, the effect of cooling motor unit 2 by the second airflow passage and the first airflow passage is further enhanced.

In the case where the material forming bracket 20 includes resin, this bracket 20 can be manufactured relatively easily. In the case where the material forming bracket 20 includes resin, the degree of freedom of the shape of bracket 20 is higher than that in the case where the material forming bracket 20 includes metal, for example.

Embodiment 2

<Configuration of Electric Blower>

Figure 5:
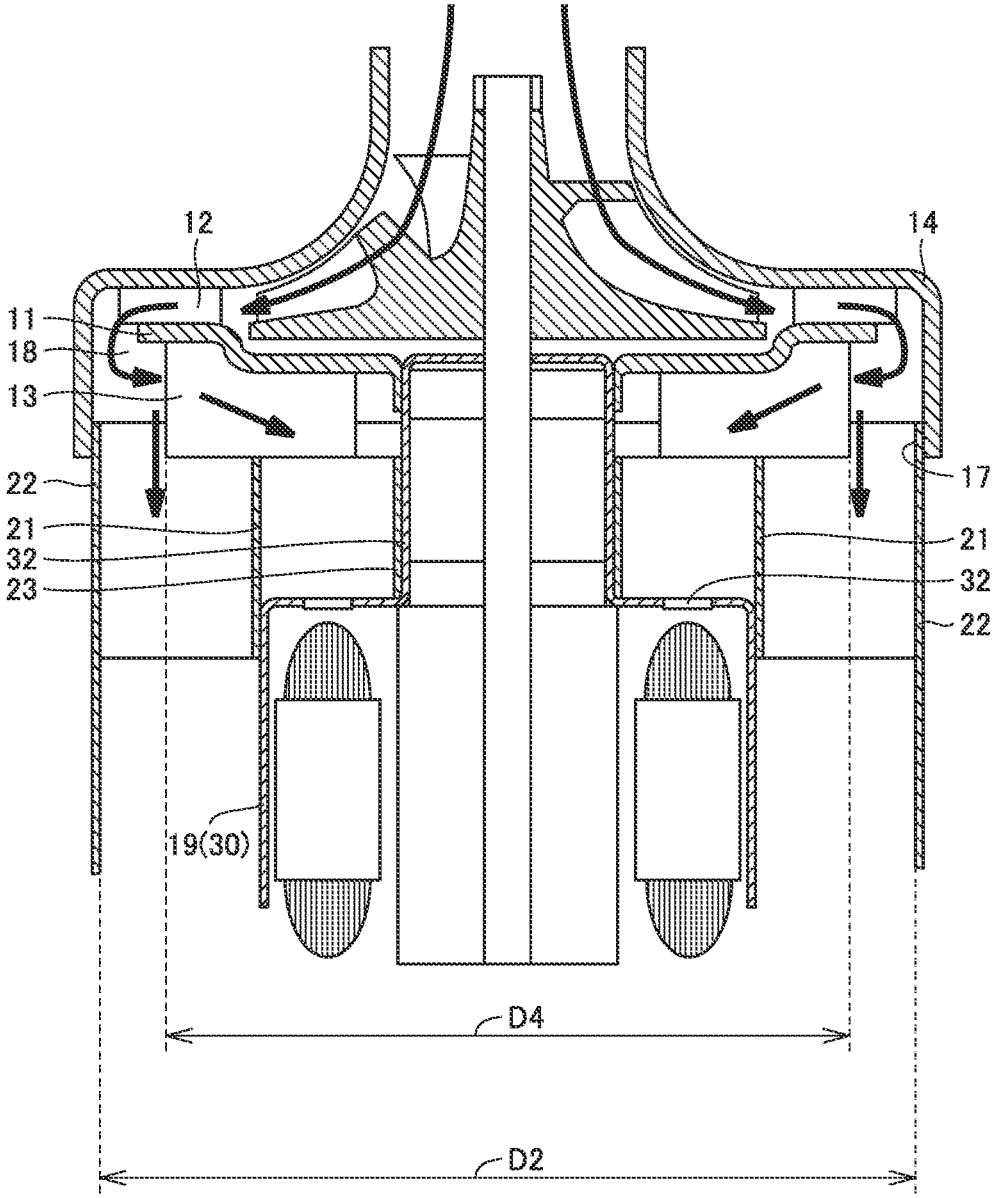
FIG. 5 is a schematic cross-sectional view showing an electric blower according to Embodiment 2.

As shown in FIG. 5, an electric blower according to Embodiment 2 is basically similar in configuration to electric blower 1 according to Embodiment 1, but differs from the electric blower in Embodiment 1 in that the back end, i.e., the other end, of second portion 22 is located further from centrifugal impeller 6 than the first portion 21 is, i.e., the back end of second portion 22 is located backward of first portion 21, in the extending direction.

The back end of second portion 22 is located further from centrifugal impeller 6 than the back end of first portion 21 is, i.e., the back end of second portion 22 is located backward of the back end of first portion 21, in the extending direction. The back end of second portion 22 is located to radially overlap a central part, in the extending direction, of portion 30 of motor unit case 19, for example. The back end of second portion 22 may be located to radially overlap the back end of portion 30 of motor unit case 19, for example.

Advantageous Effects

The electric blower according to Embodiment 2 is basically similar in configuration to electric blower 1 according to Embodiment 1, and can therefore produce similar advantageous effects to electric blower 1.

Further, in the electric blower according to Embodiment 2, the air flowing into the second airflow passage can reliably be directed by second portion 22 into the region around portion 30 of motor unit case 19. Therefore, the electric blower according to Embodiment 2 can more efficiently cool motor unit 2 as compared with electric blower 1 according to Embodiment 1.

<Modification>

Figure 6:
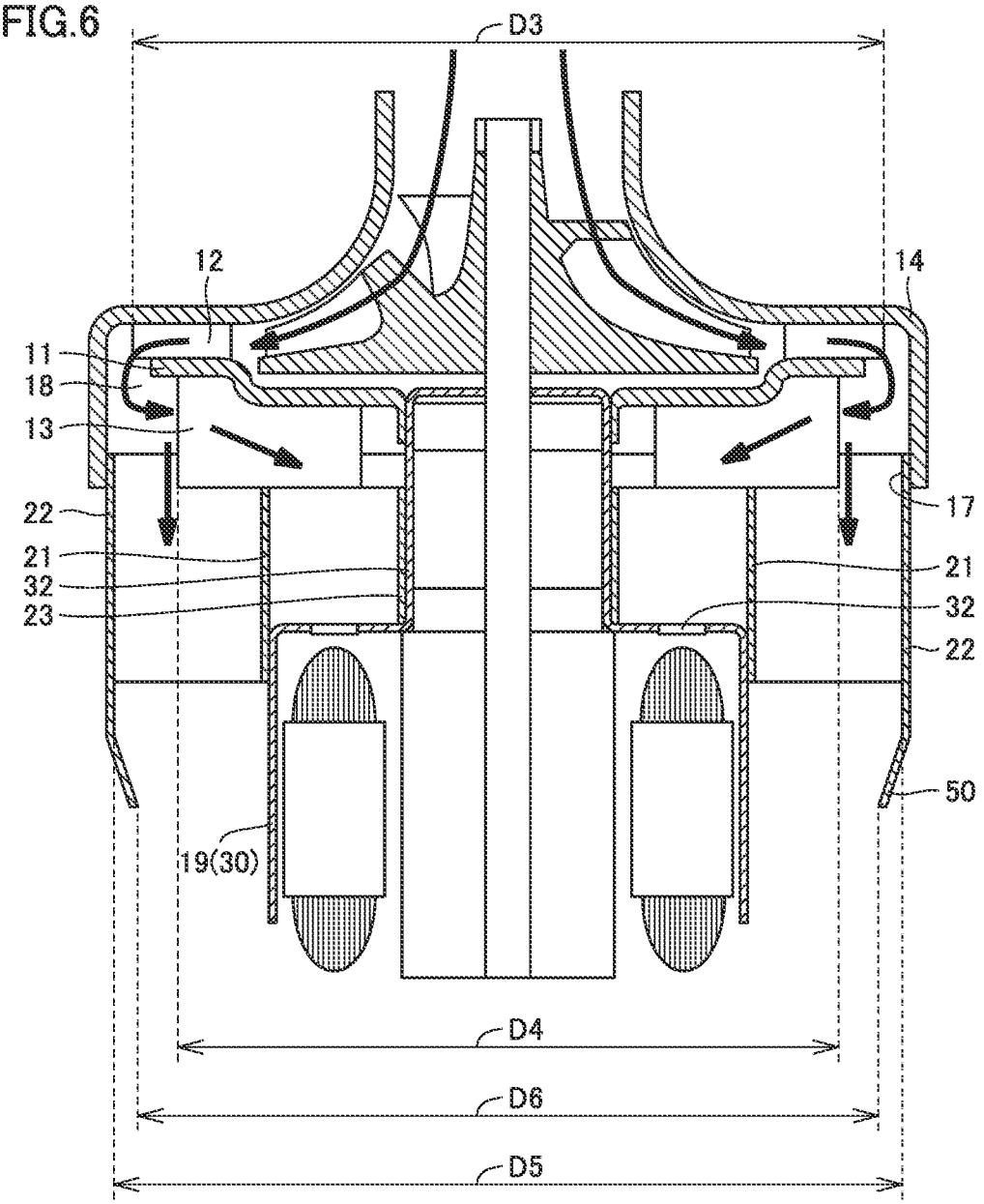
FIG. 6 is a schematic cross-sectional view showing a modification of the electric blower according to Embodiment 2.

As shown in FIG. 6, in the electric blower according to Embodiment 2, second portion 22 may include an inclined portion 50 that is inclined with respect to the extending direction. In this case, the aforementioned back end of second portion 22 is included in inclined portion 50.

In this case, the air flowing into the second airflow passage can more reliably be directed by second portion 22 into a region closer to portion 30 of motor unit case 19, as compared with the blower shown in FIG. 5. Therefore, the electric blower according to Embodiment 2 shown in FIG. 6 can more efficiently cool motor unit 2 as compared with electric blower 1 according to Embodiment 2 shown in FIG. 5.

The bracket 20 including inclined portion 50 shown in FIG. 6 may be formed as a single-piece bracket, or a separate inclined portion 50 may be connected to the back end of second portion 22 of bracket 20 shown in FIG. 5.

As shown in FIG. 6, inner diameter D5 of the front end of second portion 22, inner diameter D6 of the back end of second portion 22 (back end of inclined portion 50), and outer diameter D4 of the circle circumscribing return stator vanes 13 satisfy a relation: D5>D6>D4. Preferably, inner diameter D5 of the front end of second portion 22, inner diameter D6 of the back end of second portion 22 (back end of inclined portion 50), and outer diameter D3 of the circle circumscribing stator vanes 12 satisfy a relation: D5>D6>D3. In this way, the air flowing into the second airflow passage can more reliably be directed by inclined portion 50 toward portion 30 of motor unit case 19, and increase of the airflow impedance of the second airflow passage can be suppressed.

Embodiment 3

Figure 7:
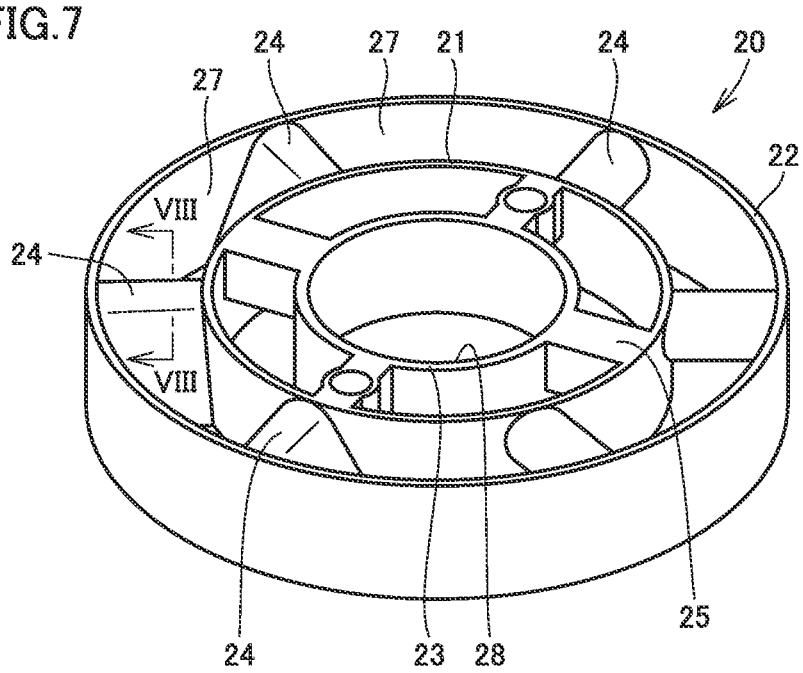
FIG. 7 is a perspective view showing a bracket of an electric blower according to Embodiment 3.
Figure 8:
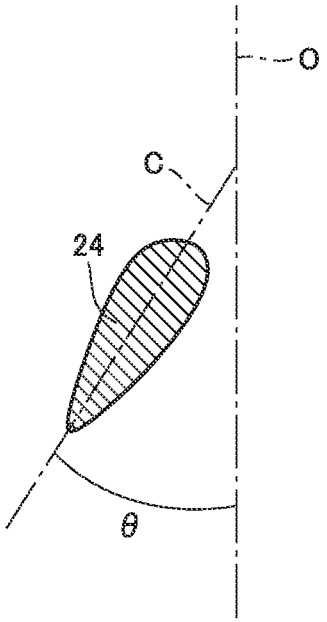
FIG. 8 is a cross-sectional view along a line VIII-VIII in FIG. 7.

As shown in FIGS. 7 and 8, an electric blower according to Embodiment 3 is basically similar in configuration to electric blower 1 according to Embodiment 1, but differs from the electric blower in Embodiment 1 in that coupling portion 24 has an airfoil-shape cross section perpendicular to the radial direction.

As shown in FIGS. 7 and 8, the aforementioned cross-sectional shape of coupling portion 24 has the transverse direction and the longitudinal direction. This cross-sectional shape of coupling portion 24 includes a portion having the width in the transverse direction that increases gradually from the front end toward the back end of coupling portion 24, and a portion having the width in the transverse direction that decreases gradually to the back end of coupling portion 24, in the cross section of coupling portion 24 perpendicular to the radial direction. This cross-sectional shape of coupling portion 24 is the shape having the width increasing gradually from the front end of the arc shape, and then decreasing gradually to terminate at a sharp back end.

As shown in FIG. 8, in the cross section of coupling portion 24 perpendicular to the radial direction, a line C connecting centers in the transverse direction of coupling portion 24 is preferably inclined at angle θ with respect to line O in the extending direction. The back end of coupling portion 24 is located forward in the rotational direction of centrifugal impeller 6, relative to the front end of coupling portion 24. The air flowing in the second airflow passage is the air discharged from diffuser 10, and therefore, the speed of the air includes a component in the extending direction and a rotational component in the rotational direction. Preferably, angle θ is substantially equal to the angle of inclination of the rotational component with respect to the extending direction.

Advantageous Effects

The electric blower according to Embodiment 3 is basically similar in configuration to electric blower 1 according to Embodiment 1, and can therefore produce similar advantageous effects to electric blower 1.

Further, in the electric blower according to Embodiment 3, coupling portion 24 has an airfoil-shape cross section perpendicular to the radial direction. Therefore, the air flowing out from the second airflow passage located between a plurality of coupling portions 24 that are arranged between first portion 21 and second portion 22 is not separated from coupling portions 24 but can flow smoothly along the surfaces of coupling portions 24. Thus, in the electric blower according to Embodiment 3, the airflow impedance of the second airflow passage is further reduced as compared with electric blower 1 according to Embodiment 1.

Further, line C connecting centers in the transverse direction of coupling portion 24 is inclined at angle θ with respect to the extending direction. Therefore, the resistance against the air flowing into the second airflow passage and passing by coupling portions 24 is lower than a blower in which line C connecting centers in the transverse direction of coupling portion 24 is not inclined at angle θ with respect to the extending direction. Accordingly, in the electric blower according to Embodiment 3, the airflow impedance of the second airflow passage is further lower than electric blower 1 according to Embodiment 1.

Embodiment 4

Figure 9:
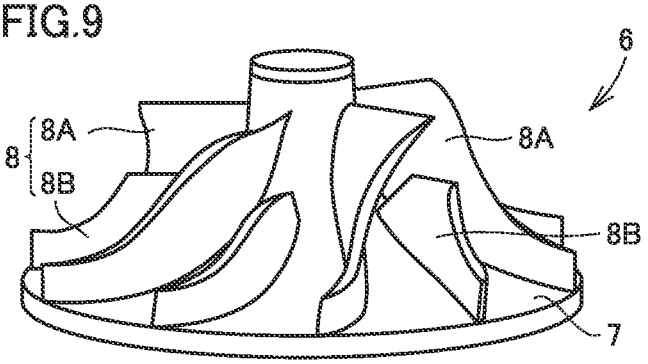
FIG. 9 is a perspective view showing a centrifugal impeller of an electric blower according to Embodiment 4.

As shown in FIG. 9, an electric blower according to Embodiment 4 is basically similar in configuration to electric blower 1 according to Embodiment 1, but differs from the electric blower according to Embodiment 1 in that centrifugal impeller 6 includes a first blade 8A and a second blade 8B relatively narrower than first blade 8A in width in the extending direction.

The front end of second blade 8B is located backward of the front end of first blade 8A. The edge of second blade 8B that is located radially inside at the front end is located radially outward of the edge of first blade 8A that is located radially inside at the front end.

Advantageous Effects

The electric blower according to Embodiment 4 is basically similar in configuration to electric blower 1 according to Embodiment 1, and can therefore produce similar advantageous effects to electric blower 1.

Further, in the electric blower according to Embodiment 4, the number of blades is increased on the back side of the airflow passage formed between rotor blades 8 of centrifugal impeller 6. Therefore, on the lower air volume side, the flow in centrifugal impeller 11 is easily directed along first blade 8A and second blade B. Thus, in the electric blower according to Embodiment 4, generation of secondary flow in centrifugal impeller 11 is suppressed, which increases the efficiency of the electric blower.

Embodiment 5

<Configuration of Electric Vacuum Cleaner>

Figure 10:
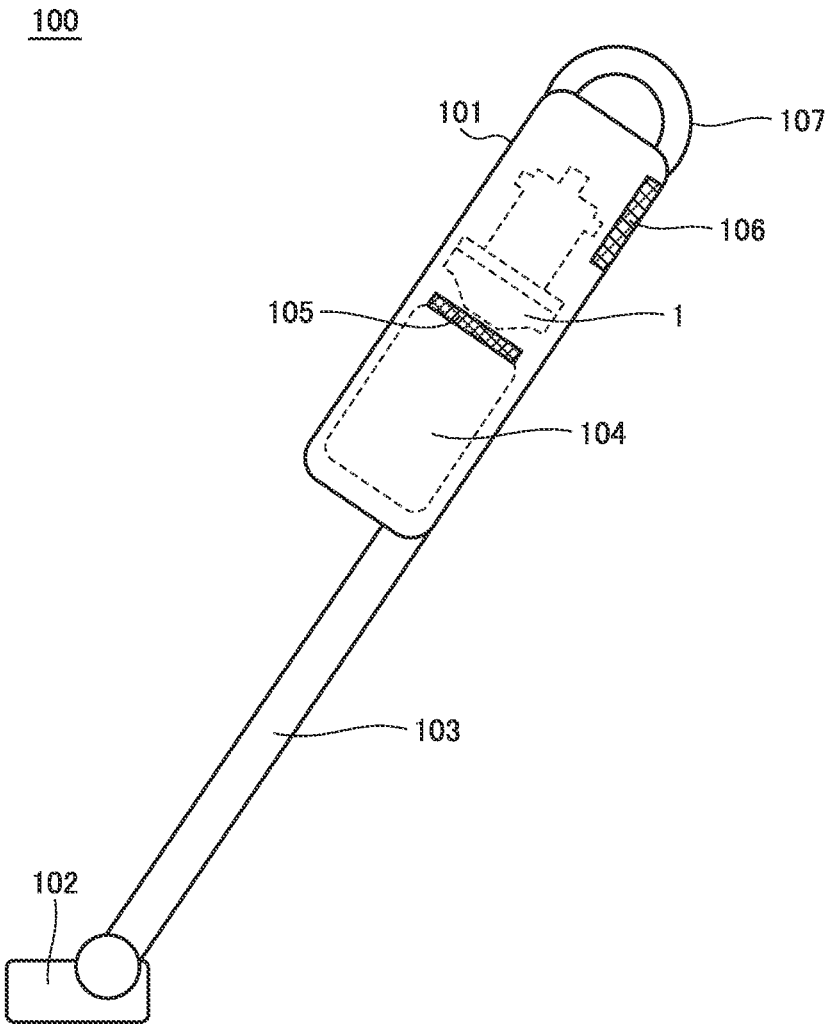
FIG. 10 is a schematic diagram showing an electric vacuum cleaner according to Embodiment 5.

Referring to FIG. 10, an electric vacuum cleaner 100 according to Embodiment 5 is described. Electric vacuum cleaner 100 includes at least any one of the electric blowers according to Embodiments 1 to 4. Electric vacuum cleaner 100 includes an electric vacuum cleaner main body 101, a suction tool 102, and an extension pipe 103, as well as a dust collector 104, a filter 105, and aforementioned electric blower 1 that are disposed inside electric vacuum cleaner main body 101, for example.

Electric vacuum cleaner main body 101 is connected to suction tool 102 through extension pipe 103. In electric vacuum cleaner main body 101, dust collector 104 that collects dust contained in air sucked by suction tool 102 and holds the collected dust therein, filter 105, electric blower 1, and an exhaust port 106 are arranged.

Suction tool 102 is coupled to electric vacuum cleaner main body 101 through extension pipe 103 serving as a tubular member, for sucking air from an area to be cleaned. Extension pipe 103 has one end connected to suction tool 102 and the other end connected to electric vacuum cleaner main body 101.

Dust collector 104 communicates with suction tool 102 through extension pipe 103 for holding dust contained in the sucked air. Electric blower 1 is disposed inside electric vacuum cleaner main body 101, for sucking air from suction tool 102 into dust collector 104. Electric blower 1 is any of the electric blowers according to the embodiments of the present invention described above. Exhaust port 106 is located on the back side of electric vacuum cleaner main body 101, for letting out the air from which dust has been collected by dust collector 104, to the outside of electric vacuum cleaner main body 101.

On the lateral side of electric vacuum cleaner main body 101, a handle 107 is disposed.

<Operation of Electrical Vacuum Cleaner>

Referring next to FIG. 10, operation of the electric vacuum cleaner is described. In the electric vacuum cleaner configured in the above-described manner, shaft 5 (see FIG. 1) is rotated as power is fed to motor unit 2 of electric blower 1. As shown in FIG. 1, as shaft 5 is rotated, centrifugal impeller 6 fastened to shaft 5 is rotated to suck air from inlet 15. Accordingly, air on a surface to be cleaned is sucked into electric vacuum cleaner main body 101 through suction tool 102 and extension pipe 103 coupled to electric vacuum cleaner main body 101 shown in FIG. 10. Dust contained in the air sucked into electric vacuum cleaner main body 101 is collected into dust collector 104.

After this, the air discharged from dust collector 104 through filter 105 is sucked from inlet 15 of electric blower 1 as shown in FIG. 1. The air sucked into electric blower 1 is increased in pressure and speed by centrifugal impeller 6 and directed radially outward while being turned. Most of the air discharged from centrifugal impeller 6 is reduced in speed and increased in pressure between a plurality of stator vanes 12. The air is thereafter directed through the first airflow passage and the second airflow passage and discharged to the outside of electric blower 1. Then, the air is discharged to the outside of electric vacuum cleaner main body 101 from exhaust port 106 located in electric vacuum cleaner main body 101 shown in FIG. 10.

<Advantageous Effects of Electric Vacuum Cleaner>

Because high-efficiency electric blower 1 is used for electric vacuum cleaner 100, the electric vacuum cleaner with high suction power can be obtained.

Electric vacuum cleaner 100 may include any of the electric blowers according to Embodiments 2 to 4. In this case as well, the suction power of electric vacuum cleaner 100 can be increased.

While above-described electric vacuum cleaner 100 is a cordless stick type vacuum cleaner in which extension pipe 103 is coupled to electric vacuum cleaner main body 101, electric vacuum cleaner 100 may be any of other types of electric vacuum cleaners. For example, any of the electric blowers according to Embodiments 1 to 4 may also be applied to a canister-type electric vacuum cleaner in which a hose and an extension pipe are connected to the electric vacuum cleaner main body, foe example.

Embodiment 6

<Configuration of Hand Drier>

Figure 11:
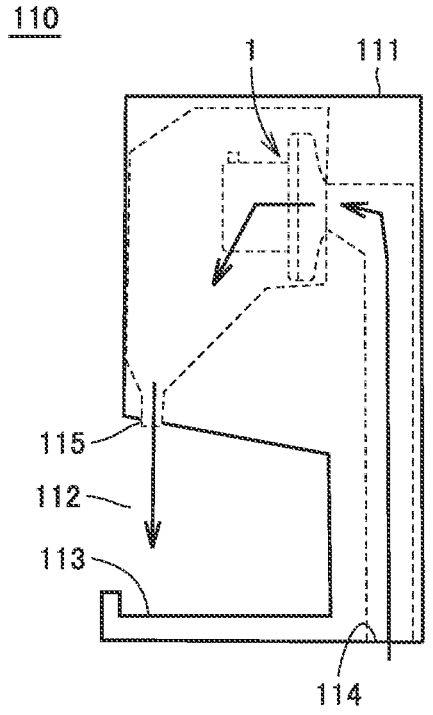
FIG. 11 is a schematic diagram showing a hand drier according to Embodiment 6.

Referring next to FIG. 11, a hand drier 110 according to Embodiment 6 is described. Hand drier 110 includes at least any one of the electric blowers according to Embodiments 1 to 4. Hand drier 110 includes electric blower 1, a casing 111 as a main body, a hand insert portion 112, a water receiver 113, an inlet 114, and a nozzle 115, for example. In the hand drier, electric blower 1 is contained in casing 111. In the hand drier, hand/hands is/are inserted in hand insert portion 112 located above water receiver 113, and water on the hand/hands is blown away by the air blown by electric blower 1. The blown-away water is collected from water receiver 113 into a drain container (not shown).

Casing 111 forming the outer shell of the hand drier has a hand insert opening in the front side. Casing 111 has hand insert portion 112 as a process space continuing from the hand insert opening. A user can insert hand/hands in hand insert portion 112. Hand insert portion 112 is located in a lower front portion of casing 111 and formed as an open sink recess with its front side and the opposite lateral sides opened. Water receiver 113 is disposed to form a lower part of hand insert portion 112. In the upper part of hand insert portion 112, nozzle 115 is disposed to blow air at a high rate in the downward direction toward hand insert portion 112. The lower side of casing 111 has inlet 114.

Electric blower 1 is disposed in the internal space of casing 111. Electric blower 1 is driven by externally supplied electric power or electric power from a power source such as battery disposed inside casing 111, for example. In this space, an intake air passage allowing the intake side of electric blower 1 to communicate with inlet 114 located in a side of casing 111, and an exhaust air passage allowing the exhaust side of electric blower 1 to communicate with nozzle 115 are located.

A heater may be located upstream of and near nozzle 115 in the exhaust air passage for heating air discharged from electric blower 1. A circuit board including a hand detection sensor and a lighting LED may be disposed in casing 111 and located backward of nozzle 115 serving as an outlet. The hand detection sensor detects whether hand/hands is/are inserted in hand insert portion 112. In response to detection of hand/hands in hand insert portion 112, the lighting LED serving as lighting means illuminates hand insert portion 112.

<Operation of Hand Drier>

Next, operation of the hand drier in use for drying hand/hands is described. As a power switch of an electrical apparatus serving as a hand drier is turned on, a control circuit for example located in casing 111 is powered to cause the hand drier to enter an available state (hereinafter standby state) in which hand/hands can be dried. As a user inserts wet hand/hands from the hand insert opening into hand insert portion 112 so that the hand/hands substantially up to the wrist/wrists is/are located within the hand insert portion, the hand detection sensor detects insertion of the hand/hands. As a result, the control circuit actuates the electric blower.

As electric blower 1 is actuated, air outside the hand drier is sucked from inlet 114. The air sucked from inlet 114 is sucked through the intake side of electric blower 1 into the electric blower. Electric blower 1 converts the air sucked from the intake side into high-pressure air and discharges the high-pressure air from the exhaust side. The discharged high-pressure air flows in the exhaust passage to reach nozzle 115, and is converted into a high-speed airflow having a high kinetic energy. The high-speed airflow is blown off from nozzle 115 downward into hand insert portion 112. The high-speed airflow blown off from nozzle 115 is received by the wet hand/hands inserted in hand insert portion 112 to blow water sticking to the hand/hands off from the surface of the hand/hands. In this way, the hand/hands can be dried. If a heater switch (not shown) disposed in casing 111 is ON, the heater is powered to heat the high-pressure air flowing in the exhaust air passage. In this way, it is possible to keep the user feel comfortable even in winter by the hot air blown from the nozzle.

The dried hand/hands is/are removed from hand insert portion 112. Then, the removal of the hand/hands is detected by the hand detection sensor and the electric blower is stopped. Water droplets blown away from the hand/hands are collected in water receiver 113 inclined frontward.

<Advantageous Effects of Hand Drier>

Above-described hand drier 110 for which above-described high-efficient electric blower 1 is used is thus highly efficient.

Hand drier 110 may also include any of the electric blowers according to Embodiments 2 to 4. Such hand drier 110 is also highly efficient.

<Modification>

Figure 12:
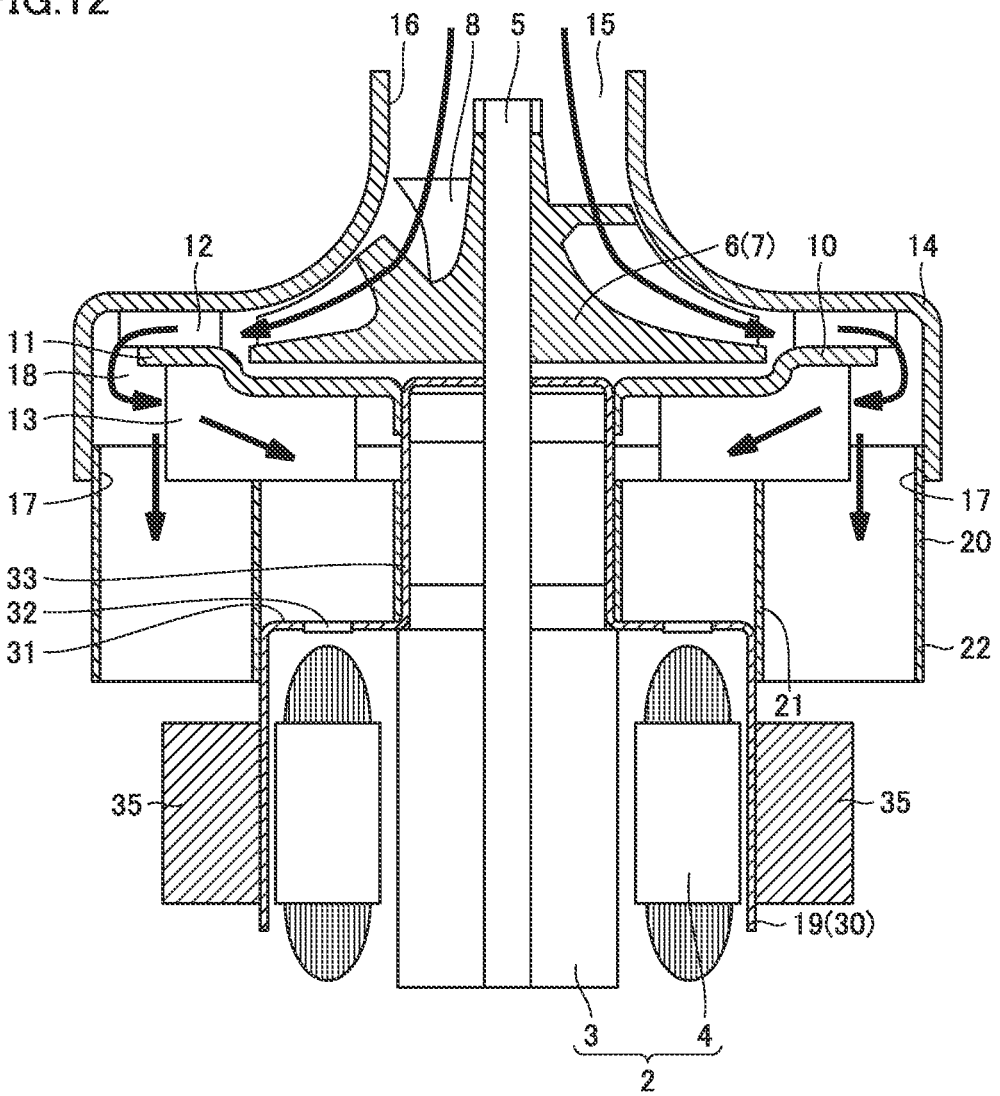
FIG. 12 is a schematic cross-sectional view showing a modification of the electric blowers according to Embodiments 1 to 4.

In the electric blowers according to Embodiments 1 to 4, motor unit case 19 may have any configuration for achieving a high cooling efficiency. For example, as shown in FIG. 12, motor unit case 19 may include a heat-radiating fin 35 connected to portion 30. Heat-radiating fin 35 is located on the back side relative to the back end of second portion 22, for example. In this way, the cooling efficiency for motor unit 2 can further be increased while a high blowing efficiency equivalent to that of the electric blowers according to Embodiments 1 to 4 is maintained.

While the embodiments of the present invention have been described, the embodiments disclosed herein can be modified in various manners. It is intended that the scope of the present invention is defined by claims and encompasses all modifications equivalent in meaning and scope to the claims.

REFERENCE SIGNS LIST

1 electric blower; 2 motor unit; 3 rotor; 4 stator; 5 shaft; 6 centrifugal impeller; 7 hub; 8 rotor blade; 8A first blade; 8B second blade; 10 diffuser; 11 main plate; 12 stator vane; 13 return stator vane; 14 fan cover; 15 inlet; 16 bell mouth; 17 opening; 18 deflector; 19 motor unit case; 20 bracket; 21 first portion; 22 second portion; 23 third portion; 24, 25 coupling portion; 26 first through hole; 27 second through hole; 28 third through hole; 29 fourth through hole; 32 vent; 34 fastening hole; 40, 41 fastening member; 42 through hole; 50 inclined portion; 100 electric vacuum cleaner; 101 electric vacuum cleaner main body; 102 suction tool; 103 extension pipe; 104 dust collector; 105 filter; 106 exhaust port; 107 handle; 110 hand drier; 111 casing; 112 hand insert portion; 113 water receiver; 114 inlet; 115 nozzle

The invention claimed is:

1. An electric blower comprising:

a motor unit;

a shaft to be driven by the motor unit;

a centrifugal impeller fastened to the shaft;

a fan cover that houses the centrifugal impeller;

a motor unit case that houses the motor unit and has a vent located in the motor unit case; and a bracket located away from the centrifugal impeller and toward the motor unit in a direction in which a central axis of the shaft extends, the bracket comprising a first portion located outward of the vent in a radial direction which is a direction of a radius centered at the central axis, and a second portion located outward of the first portion and outward of an outer circumference of the motor unit case in the radial direction, a first airflow passage and a second airflow passage being formed in the bracket, the first airflow passage and the second airflow passage communicating with an airflow passage formed by the centrifugal impeller and the fan cover, the first airflow passage being defined by at least an inner circumferential surface of the first portion, the second airflow passage being defined by at least an outer circumferential surface of the first portion and an inner circumferential surface of the second portion.

2. The electric blower according to claim 1, wherein an area of the second airflow passage is larger than an area of the first airflow passage as seen in the direction in which the shaft extends.

3. The electric blower according to claim 1, further comprising a diffuser located downstream of the centrifugal impeller and located upstream of the bracket, with respect to the airflow passage formed by the centrifugal impeller, wherein the diffuser comprises a plurality of stator vanes and a plurality of return stator vanes, and the first portion is located radially inward of a radially outer end of at least one of the plurality of return stator vanes.

4. The electric blower according to claim 3, wherein a radially inner end of at least one of the plurality of return stator vanes is located radially inward of the first portion.

5. The electric blower according to claim 3, wherein the diffuser further comprises a main plate coupling the plurality of stator vanes to the plurality of return stator vanes, the plurality of stator vanes are arranged annularly on a side of the main plate, the side facing the centrifugal impeller, a diameter of a rim circumscribing radially outer ends of the plurality of stator vanes is larger than a diameter of a rim inscribing a radially outer rim of the main plate.

6. The electric blower according to claim 1, wherein the first portion has one end and another end in the direction in which the shaft extends, the one end being coupled to the motor unit case, and the other end not being coupled to the motor unit case, the second portion has one end and another end in the direction in which the shaft extends, the one end being coupled to the fan cover, and the other end not being coupled to the fan cover, and in the direction in which the shaft extends, the other end of the second portion is located further from the centrifugal impeller than the first portion is.

7. The electric blower according to claim 6, wherein the second portion comprises an inclined portion inclined toward the motor unit case with respect to the direction in which the shaft extends, and the other end of the second portion is included in the inclined portion.

8. The electric blower according to claim 1, wherein a material forming the motor unit case comprises metal.

9. The electric blower according to claim 1, wherein a material forming the bracket comprises resin.

10. The electric blower according to claim 1, wherein the bracket further comprises a coupling portion coupling the first portion to the second portion, and the coupling portion has an airfoil-shape cross section perpendicular to the radial direction which is the direction of a radius centered at the central axis of the shaft.

11. The electric blower according to claim 1, wherein the centrifugal impeller comprises a hub connected to the shaft and having a surface extending in a direction crossing the direction in which the shaft extends, and a plurality of blades connected to the surface of the hub.

12. The electric blower according to claim 11, wherein the plurality of blades comprise a first blade and a second blade relatively narrower than the first blade in width in the direction in which the shaft extends.

13. An electric vacuum cleaner comprising:

an electric vacuum cleaner main body;

a suction tool coupled to the electric vacuum cleaner main body by a tubular member and configured to suck air from an area to be cleaned;

a dust collector located in the electric vacuum cleaner main body, communicating with the suction tool, and configured to collect dust in the sucked air; and an electric blower according to claim 1, the electric blower being located in the electric vacuum cleaner main body and configured to suck air from the suction tool into the dust collector, an exhaust port being located in an outer surface of the electric vacuum cleaner main body, air from which dust is collected by the dust collector being discharged outward of the electric vacuum cleaner main body through the exhaust port.

14. A hand drier comprising:

a main body comprising a hand insert portion, the hand insert portion being an opening for a user to insert a hand; and an electric blower according to claim 1, the electric blower being located in the main body, an inlet and an outlet being formed in the main body, outdoor air being taken in through the inlet by the electric blower, the outdoor air discharged from the electric blower being blown out toward the hand insert portion through the outlet.

* * * * *